United States Patent [19]

Look

[11] 4,111,015

[45] Sep. 5, 1978

[54] SKI LOCK

[76] Inventor: Robert A. Look, 8404 W. Mercer Way, Mercer Island, Wash. 98040

[21] Appl. No.: 517,200

[22] Filed: Nov. 12, 1974

Related U.S. Application Data

[62] Division of Ser. No. 322,906, Jan. 11, 1973, Pat. No. 3,967,476.

[51] Int. Cl.[2] ..... E05B 73/00

[52] U.S. Cl. ..... 70/58; 280/600

[58] Field of Search ..... 70/57–58, 70/67, 69, 71, 80; 280/11.13 E, 11.13 V, 11.13 P, 11.13 L, 11.13 M, 11.13 W, 11.13 S, 11.13 T, 11.37 S, 11.37 A, 11.37 E, 11.37 C, 11.37 T; 211/60 SK, 4; 16/45 S, 5 Z

[56] References Cited

U.S. PATENT DOCUMENTS

| | | | |
|---|---|---|---|
| 2,136,493 | 11/1938 | Denerich | 70/80 |
| 3,272,522 | 9/1966 | Kennedy | 280/11.13 L |
| 3,277,676 | 10/1966 | Poehlmann | 70/58 |
| 3,461,696 | 8/1969 | Seka | 70/58 |

FOREIGN PATENT DOCUMENTS

| | | | |
|---|---|---|---|
| 1,512,617 | 1/1968 | France | 70/58 |
| 226,705 | 7/1943 | Switzerland | 280/11.37 A |

*Primary Examiner*—Robert L. Wolfe
*Attorney, Agent, or Firm*—Thomas W. Secrest

[57] ABSTRACT

A ski lock for locking skis in a crossed position so as to discourage theft of the skis. A male stamped bracket having a protruding strike and cross mounted on one ski slidably engages a female stamped bracket having a receptacle type lock, the female stamped bracket being longitudinally mounted on the second ski.

5 Claims, 16 Drawing Figures

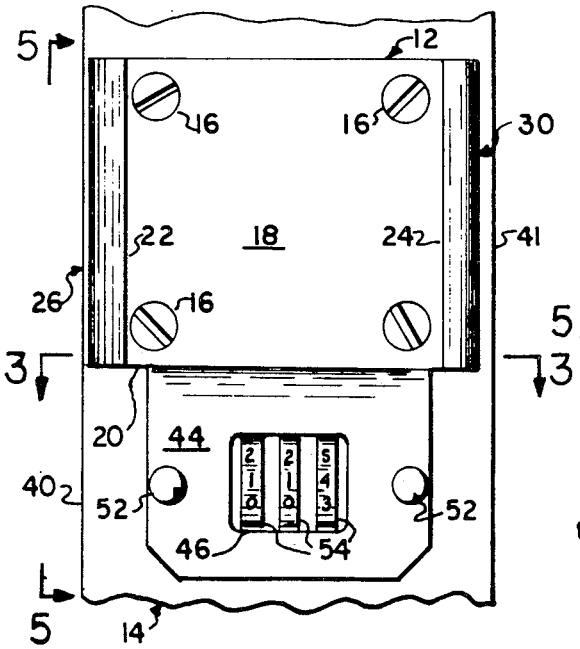
FIG. 1
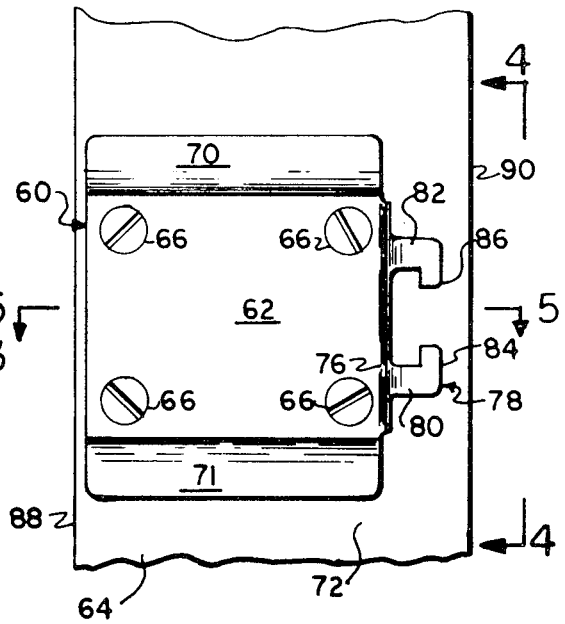
FIG. 2
FIG. 3
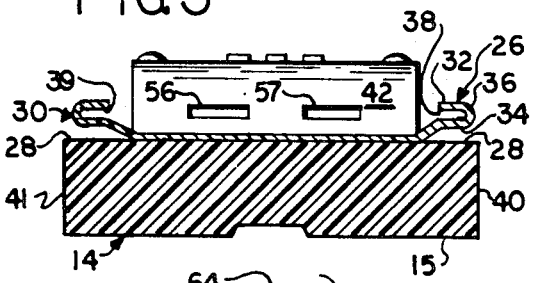
FIG. 4
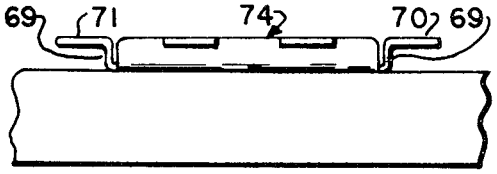
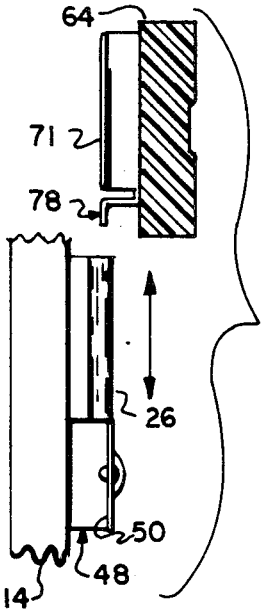
FIG. 5
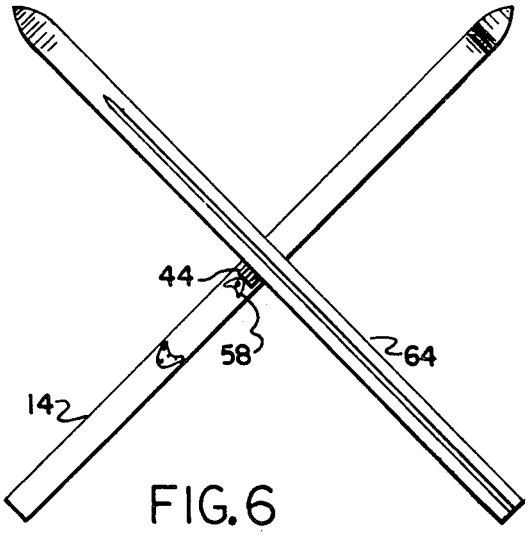
FIG. 6

SKI LOCK

This application is a divisional application of my copending application Ser. No. 332,906, filing date of Jan. 11, 1973, and now U.S. Pat. No. 3,967,476 entitled SKI LOCK.

BACKGROUND OF THE INVENTION

1. Field of the Invention

This invention relates to devices for preventing theft of portable objects, and particularly to a novel and useful ski lock designed to discourage the theft of skis, and, in particular, from a skiing area and near the ski lodge.

2. Brief Description of the Prior Art

Skiing has become one of the most popular sports engaged in by the public at large; so much so that, on a given day, thousands of skiers may congregate in one area to engage in the sport. Most skiing areas are equipped with day lodges and rest rooms. In order to use such facilities, it is, of course, necessary for the skier to remove his or her skis. Because of the general lack of safekeeping facilities, the skier commonly stabs his or her skis and poles into the snow into a small area where perhaps hundreds of others have left their skis in a similar position. Because of the high cost of skis and the bindings thereon, such equipment is inviting to other skiers and people who have rented skis and thieves. A means of discouraging the theft of the skis is to lock the skis in a crossed position so that they will be difficult and conspicuous to carry, and difficult to transport in or on a vehicle. An owner of a pair of skis, having the means to unlock the skis from a crossed position, would not, ordinarily, carry them or transport them in that position. It would thus be apparent that a person carrying the skis locked in a crossed position would probably not be the owner of the skis and would, prima facie, be suspected of having stolen them. The crossed skis would be a signal to other skiers that the skis were, possibly being stolen.

Patents have been issued claiming devices for locking skis together and for locking skis in a crossed position. In some of the patented or disclosed devices, the ski owner must carry on his person, when the skis are being used for skiing, a lock, or a locking cable, or a pair of brackets or the like. Such articles often have sharp corners or edges and, when carried on the person may cause injury to the skier when he falls, as all skiers do from time to time. It is also possible for the skier to lose much articles on the ski slopes, rendering the lock useless. Such patented or disclosed ski cross-locking devices, as are completely contained on the skis themselves, tend to be relatively complicated or expensive to manufacture.

SUMMARY OF THE INVENTION

The present invention comprises a male bracket, crossmounted on one ski of a pair of skis, and having a lock striker plate extending therefrom. There is a female bracket longitudinally mounted on the second ski of the pair of skis, and having at one end a receptacle type of combination lock, suitable for receiving the lock striker of the male bracket. When the male bracket is inserted into the female bracket so that the striker is fully engaged with the combination lock, only the face plate of the combination lock, with the dials accessible thereon, extends beyond the crossing area of the two skis. The combination dials are thus accessible for opening the lock. The entire device is contained on the skis themselves, and it is not necessary for the person using the skis for skiing to carry any other equipment such as a padlock, cable or other device which may be bulky or may have corners and sharp edges. Unless the lock is open to the proper combination of numbers, the skis cannot be removed from the locked position without serious damage to the skis or virtual destruction of them, thus further tending to discourage theft. The brackets are made by simple stamping, bending and riveting processes, thus permitting low cost manufacture. It is an object of this invention to provide a ski lock which will enable skiers to securely lock their skis in a crossed position quickly and conveniently. It is a further object of this invention to provide a lock which is completely self contained on the skis themselves. Another object is to provide a lock having a low manufacturing cost and a high degree of reliability. An additional object is to provide a ski lock, one embodiment of which may be installed on a pair of skis with the use of simple tools.

BRIEF DESCRIPTION OF THE DRAWINGS

FIGS. 1–6 illustrate a first embodiment of the invention wherein the members of the lock may be mounted on the ski and wherein FIG. 1 is a plan view of a portion of one ski of a pair of skis and having the female bracket and lock mounted thereon;

FIG. 2 is a plan view of a portion of the other ski of a pair of skis and having the male bracket and strike mounted thereon;

FIG. 3 is a sectional view taken at line 3—3 of FIG. 1;

FIG. 4 is an elevational view taken at line 4—4 of FIG. 2;

FIG. 5 is an elevation view showing the proper relationship of the male bracket to the female bracket immediately prior to the proper assembly of the two brackets or immediately following disassembly of the two brackets;

FIG. 6 is an elevational view of a pair of skis locked in crossing relationship by means of the lock of FIGS. 1 and 2, and showing the location of the lock with respect to the location of the ski bindings;

FIGS. 7–10 illustrate a second embodiment of the invention wherein the toe binding and the lock member are mounted on the same toe plate and wherein FIG. 7 is a plan view of the female bracket wherein the female bracket is an integral part of the toe piece of a ski binding;

FIG. 8 is a side elevational view of the bracket of FIG. 7;

FIG. 9 is a plan view of the male bracket wherein the male bracket is formed as an integral part of the toe piece of a ski binding;

FIG. 10 is a side elevational view of the bracket of FIG. 9;

FIGS. 11–16 illustrate a third embodiment of the invention wherein the ski binding is integral with the metal beam plate of the ski and wherein FIG. 11 is a plan view of the female bracket;

FIG. 12 is a side elevational view of the bracket of FIG. 11;

FIG. 13 is a sectional view taken at line 13—13 of FIG. 11 and illustrates the bonding of the lock member to the metal beam plate of the ski;

FIG. 14 is a plan view of the male bracket;

FIG. 15 is a side elevational view of the bracket of FIG. 14; and,

FIG. 16 is a sectional view taken at line 16—16 of FIG. 14 and illustrates the bonding of the lock member to the metal beam plate of the ski.

DESCRIPTION OF THE PREFERRED EMBODIMENTS

Figure 7:
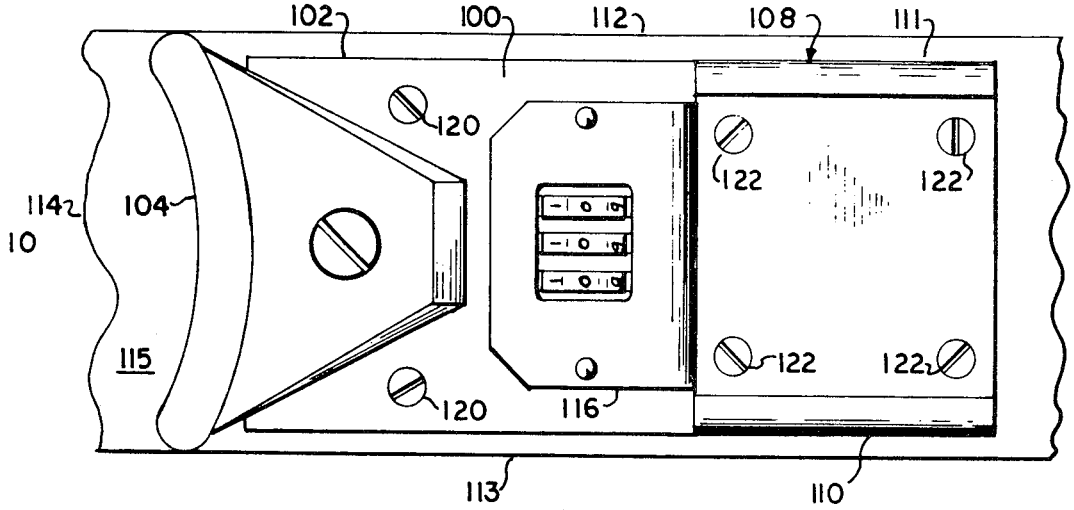

The first portion of the description will refer to FIGS. 1–6 which illustrate the first embodiment of the invention. Female bracket 12 is secured to ski 14, having a bottom surface 15 or running surface 15, by means of a plurality of screws 16. Female bracket 12 comprises a flat rectangular base 18 having a back edge 20, a first side 22 and a second side 24. A guide 26 extends the length of the first side 22 and is raised upwardly from the base 18 by angular portion 28. The guide 26 comprises an upper slide 32 and a lower slide 34, which are joined at the outer extremity of the guide 26 by arcuate portion 36. The slides 32 and 34 and the arcuate portion 36 on each of the guides 26 define an inwardly facing opening or groove 38 which is parallel to the side 40 of the ski 14. A guide 30, formed in a similar manner, but as a mirror-image of guide 26, and having an opening or groove 39 the mirror-image of opening or groove 38, extends upwardly along side 24 of the bracket 12. The guide 30 is parallel to the side 41 of the ski 14. The sides 40 and 41 of the ski 14 are parallel to each other.

End wall 42 extends perpendicularly from the edge 22 of the base 18. Cover plate 44 is a continuation of end wall 42 and is perpendicular to end wall 42. The cover plate 44 is approximately parallel to the top surface 28 of the ski 14. There is a rectangular opening 46 in the surface of the cover plate 44. A combination lock 48, similar to lock No. 440, SESAMEE COMBINATION LOCK, as illustrated on Page 16 of *CONDENSED CATALOG K*-145 (1969) of Corbin Cabinet Lock, Division of Emhart Corporation, New Britain, Conn., is attached to the under side 50 of cover plate 44 by means of rivets 52. A segment of each of the circular dials 54 of lock 48 protrudes upwardly through the opening 46, so that the dials may be turned as desired. There are two strike holes 56 and 57 extending through the end wall 42, as illustrated in FIG. 3. The female bracket 12 is mounted on the ski 14 in such a position that the cover plate 44 is adjacent to the toe binding 58, as illustrated in FIG. 6.

The male bracket 60 comprises a rectangular flat base 62 which is attached to ski 64 by means of a plurality of screws 66. Side walls 68 and 69 extend perpendicularly upwardly from opposite sides of the base 62. Legs or tongues 70 and 71 are cantilevered perpendicularly outwardly from the upper edges of the side walls 68 and 69 respectively as illustrated in FIG. 4. The legs or tongues 70 and 71 are parallel to the top surface 72 of the ski 64. The openings or grooves 38 and 39 of the female bracket 12 are of sufficient width, and are spaced apart from each other sufficiently, to slidably and snugly receive the legs or tongues 70 and 71 of the male bracket 60. The length of the legs or tongues 70 and 71 of the male bracket 60 is approximately the same as the length of the guides 26 of the female bracket 12. Front wall 74 extends upwardly from a third side 76 of the base 62. Strike 72 comprising prongs 80 and 82 extends outwardly perpendicularly from front wall 74 of the male bracket 60. Engaging ears 84 and 86 extend towards each other from the prongs 80 and 82 respectively as illustrated in FIG. 2. The strike hole 56 is of sufficient size and is so located as to permit the prong 80 and ear 84 of male bracket 60 to penetrate the end wall 42 so that the ear 84 will be lockably engaged with the lock 48. To the same effect, ear 86 may penetrate the end wall 42 through hole 57 so as to engage the lock 48. Legs or tongues 70 and 71 are parallel to each other and are each perpendicular to the sides 88 and 90 of the ski 64.

FIG. 5 illustrates the proper orientation of the ski 14 with respect to the ski 64 so as to facilitate the engagement of male bracket 60 with female bracket 12. FIG. 5 also illustrates, of course, the position of the skis 14 and 64 immediately after disengagement of the brackets. In order to lock the skis 14 and 64 together in the crossed position illustrated in FIG. 6, it is necessary first to set the combination lock dial 54 to some number other than that which will allow the lock to remain open. In other words, if the proper combination to open the lock is 3-4-5, then the numerals 1-1-4, as illustrated in FIG. 1, will indicate that the lock 48 is set to receive the strike 78 non-releasably. When it is desired to lock a pair of skis together in accordance with the teachings of this invention, a combination other than the opening combination is set on the lock 48 and the skis are placed in the crossed position illustrated in FIG. 5, with the legs or tongues 70 and 71 in line with the openings or grooves 38 and 39, respectively. The legs or tongues 70 and 71 are then engaged with the openings or grooves 38 and 39, and the strike 78 is moved toward the lock 48 until the strike 78 engages therein. In effect, the tongues slide in the path defined by the grooves. At that point, the skis are locked together as illustrated in FIG. 6, and cannot be separated from each other until the proper combination is set on the dial 54 of the lock 48, unless one wishes to destroy or seriously damage the skis by forcible separation.

Figure 8:
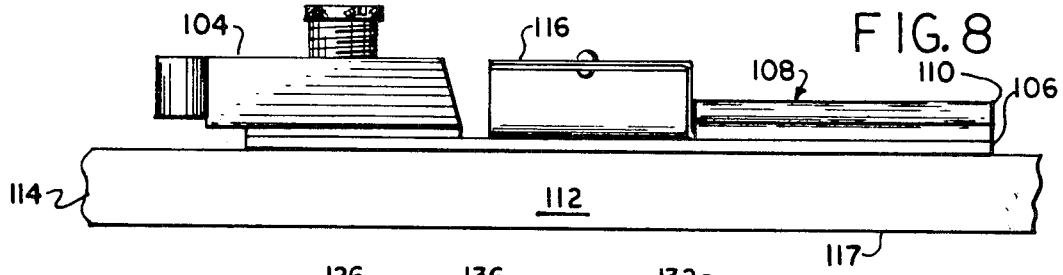
Figure 9:
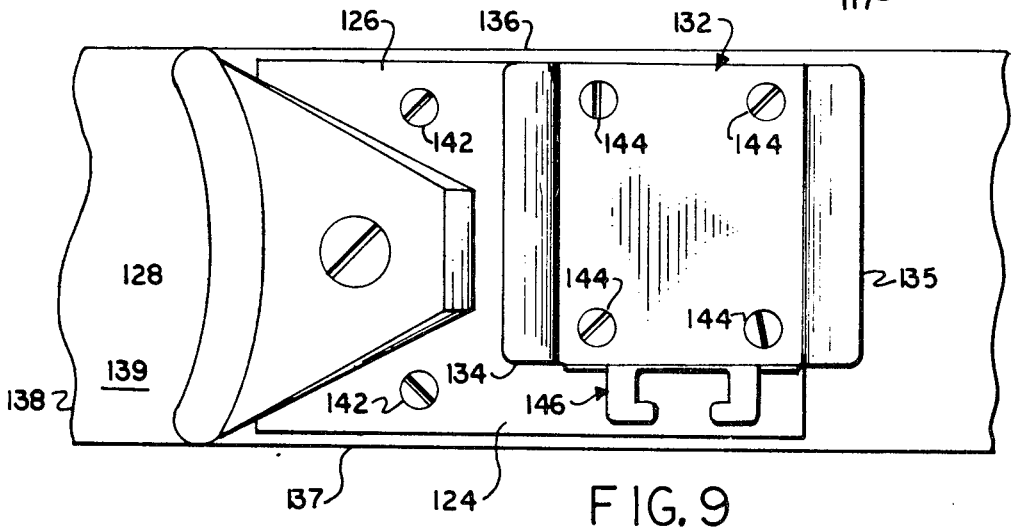
Figure 10:
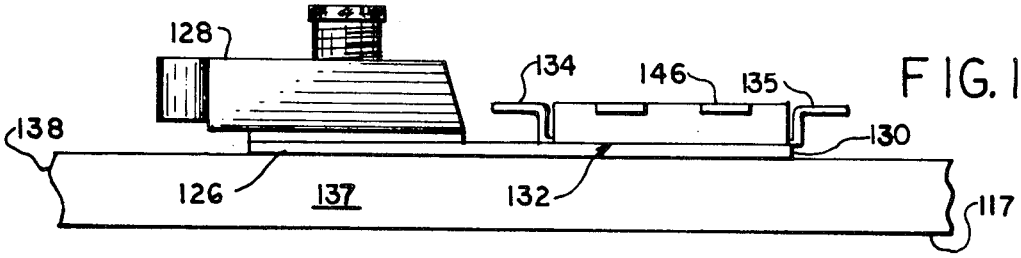

In the second embodiment of my invention, illustrated in FIGS. 7–10, there is a toe plate 100 having, at a first end 102, a toe binding 104. At a second end 106 of the toe plate 100, there is a female bracket 108, identical in all respects to the female bracket 12 of the first embodiment of my invention. Female bracket 108 is rigidly attached by welding or other suitable means to the toe plate 100 in such a position that the guides 110 and 111 are parallel to the sides 112 and 113 of the ski 114, and the cover plate 116 is approximately the same distance from the toe binding 104 as the front plate 44 of the first embodiment is spaced from the toe binding 58. The toe plate 100 is secured fixedly to the ski 114 by means of screws 120 penetrating the female bracket 108 and the second end 106 of the toe plate 100.

Also, in the second embodiment of my invention, there is a toe plate 124 having, at a first end 126 a toe binding 128, similar to the toe binding 104. At a second end 130 of the toe plate 124, there is a male bracket 132, identical to the male bracket 60 of the first embodiment of my invention. The male bracket 132 is rigidly attached by welding or other suitable means to the toe plate 124 in such a position that the legs 134 and 135 are perpendicular to the sides 135 and 137 of the ski 138, and the edge 140 of the male bracket is spaced approximately the same distance from toe binding 128 as the front plate 116 is spaced from the front plate 44 of the toe binding 104. The toe plate 124 is secured fixedly to the ski 138 by means of screws 142 penetrating the first end 126, and screws 144 penetrating the male bracket 132 and the second end 130 of the toe plate 124.

It is seen from the foregoing description of my second embodiment that the ski lock will function in the same manner as in the first embodiment as far as locking the skis together or separating them is concerned. In order to lock together the skis 114 and 138 according to the teachings of my invention, the skis are placed in a mutually perpendicular position with top surface 115 of ski 114 facing top surface 139 of ski 138 and the bottom surfaces 117 facing away from each other. Legs 134 and 135 of male bracket 132 are aligned with the inward-facing openings defined by guides 110 and 111 respectively. The legs 134 and 135 are then slideably engaged in the bracket 108 until strike 146 engages in lock 148. The second embodiment enables the ski binding and lock to be sold and installed on skis as a unit.

In the second embodiment of the invention it is seen that the ski binding and the lock member are mounted on the same toe plate.

Figure 11:
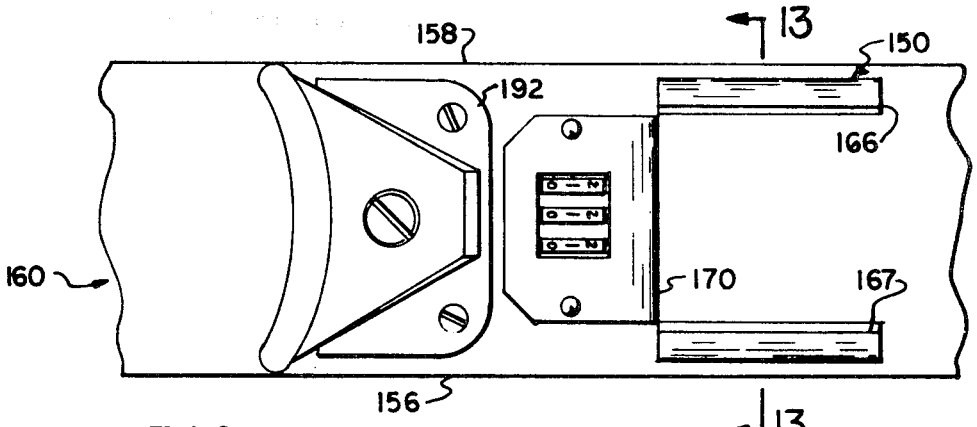
Figure 12:
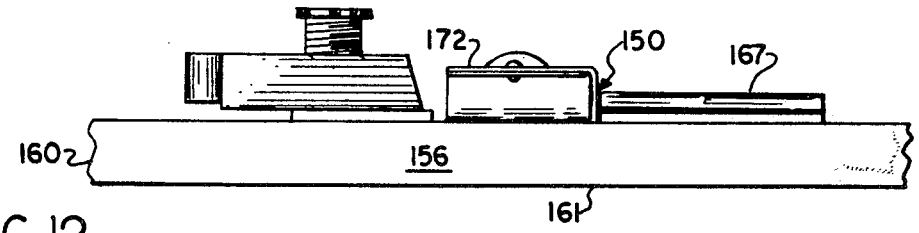
Figure 13:
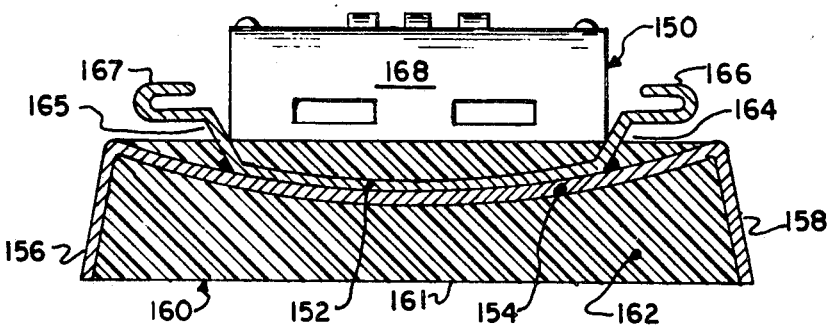
Figure 14:
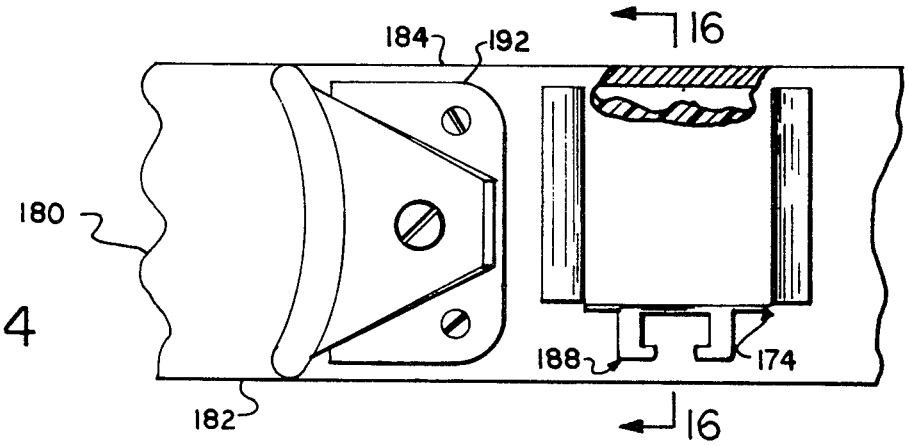
Figure 15:
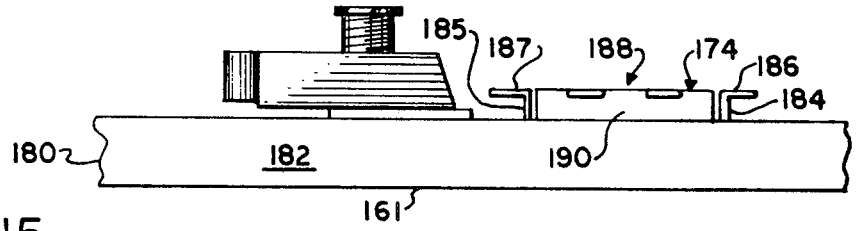
Figure 16:
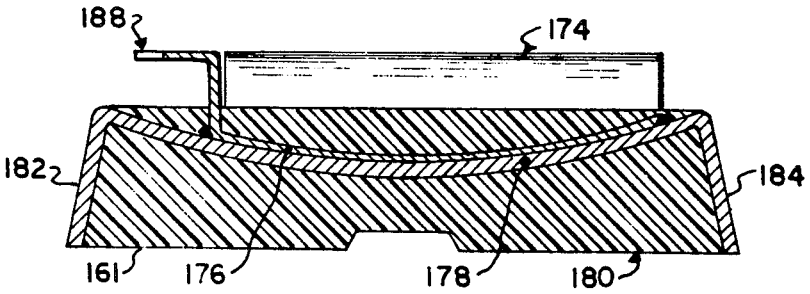

The third embodiment of my invention is illustrated in FIGS. 11–16. This embodiment is formed as an integral part of the ski itself in that the lock brackets are attached to the upper surfaces of the interior metal structure of the skis so that only the cooperating portions of the lock bracket project above the finished plastic surface of the ski. The ski has a bottom surface 161 or a running surface 161.

The female bracket 150 is formed with an arcuate base 152, conforming to the curve of the metal beam plate 154. The beam plate 154 has, at either side, downwardly depending side elements 156 and 158, forming the sides of the ski 160. The ski 160 has a plastic body 162 such as a resin or a fiberglass reinforced resin which is reinforced by the beam plate 154 and side elements 156 and 158. Guide supports 164 and 165 extend angularly upwardly from arcuate base 152, and support, respectively, guides 166 and 167 which are identical in construction to guides 26 and 30, respectively, of the first embodiment. End wall 168 extends upwardly from end 170 of arcuate base 152. A cover plate 172 extends perpendicularly from end wall 170. The cover plate 172 is identical in construction to cover plate 44 of the first embodiment, and lock 48 and its attaching and locking means may be the same type of lock in each of the embodiments. The sides 156 and 158 of ski 160 and the guides 166 and 167 are all parallel.

The male bracket 174 of the third embodiment has an arcuate base 176 attached to the metal beam plate 178 of ski 180. Side elements 182 and 184 depend downwardly from metal beam plate 178 to form the sides of the ski 180. Bracket sides 184 and 185 extend upwardly from base 176 to support legs 186 and 187 respectively, which are identical to the legs 70 of the first embodiment. Strike 188, identical to strike 78 of the first embodiment, extends outwardly from third side 190 of the male bracket 174. The male bracket 174 is mounted on the ski 180 so that the legs 186 and 187 are perpendicular to the sides 182 and 184 which are themselves parallel. Spacing of the brackets 150 and 174 from the toe pieces 192 is approximately the same as in the other embodiments. The brackets 150 and 174 will thus cooperate to lock the skis 160 and 180 in a crossed position. At the same time means attaching the brackets 150 and 174 to the skis 160 and 180 are completely inaccessible.

From the foregoing it is seen that the locking apparatus is mounted on the upper surface of the skis or the top surface of the skis. Then the skis are positioned with the top surfaces or upper surfaces facing each other. The locking apparatus can be fastened together so that the two skis form an integral unit with the upper surfaces or top surfaces facing each other.

It is seen from the foregoing that a means has been described for locking together two objects in a predetermined position relative to each other, in such a manner that the objects can only be separated by having available the combination to a combination lock, or by destroying or seriously damaging the objects; and, particularly, it is seen that a means has been described for locking together two skis in a crossed position, to the same effect. It is further seen that the locking means is completely contained on the skis themselves, so that it is not necessary for the person properly using the skis to carry any articles on his person such as keys, locks or the like, having corners or sharp edges which may harm the skier, or which may become lost.

What I claim is:

1. A combination of a pair of skiis and a locking apparatus, said combination comprising:

a. said pair of skiis comprising a first ski and a second ski;

b. said locking apparatus comprising a first bracket integral with said first ski and a second bracket integral with said second ski;

c. said first bracket and said second bracket being capable of fitting together;

d. a locking means for releasably securing together said first bracket and said second bracket;

e. said first ski and said second ski, each having a metal beam plate and wherein said beam plate is an integral part of the ski and reinforces the ski;

f. said first bracket being attached to the beam plate of said first ski by a fastening means; and, g. said second bracket being attached to the beam plate of said second ski by a fastening means.

2. A combination of a pair of skiis and a locking apparatus, said combination comprising:

a. said pair of skiis comprising a first ski and a second ski;

b. said locking apparatus comprising a first bracket integral with said first ski and a second bracket integral with said second ski;

c. said first bracket and said second bracket being capable of fitting together;

d. a locking means for releasably securing together said first bracket and said second bracket;

e. said first ski and said second ski each having a beam plate;

f. said first plate being attached to the beam plate of said first ski by a fastening means;

g. said second plate being attached to the beam plate of said second ski by a fastening means;

h. said first bracket having a first part of a guide means;

i. said second bracket having a second part of said guide means;

j. said first part and said second part may be moved relative to each other;

k. said first bracket having a first base having first opposed sides;

l. each of said first opposed sides bends back on itself to form a groove;

m. said second bracket having a second base having second opposed sides; and, n. each of said second opposed sides bends to form a tongue for sliding into a respective said groove in said first bracket.

3. A combination of a pair of skiis and a locking apparatus, said combination comprising:

a. said pair of skiis comprising a first ski and a second ski;

b. said locking apparatus comprising a first bracket integral with said first ski and a second bracket integral with said second ski;

c. said first bracket and said second bracket being capable of fitting together;

d. a locking means for releasably securing together said first bracket and said second bracket;

e. said first ski and said second ski each having a beam plate;

f. said first plate being attached to the beam plate of said first ski by a fastening means;

g. said second plate being attached to the beam plate of said second ski by a fastening means;

h. said first bracket having a first part of a guide means;

i. said second bracket having a second part of said guide means;

j. said first part and said second part may be moved relative to each other;

k. said first bracket having a first base having first opposed sides;

l. each of said first opposed sides bending upwardly, and outwardly, and back on itself to form a groove;

m. said second bracket having a second base having second opposed sides; and, n. each of said second opposed sides bends upwardly and outwardly to form a tongue for sliding into a respective said groove in said first bracket.

4. A locking apparatus according to claim 3 and comprising:

a. a first part of said locking means being on said first bracket; and, b. a second part of said locking means being on said second bracket.

5. A locking apparatus according to claim 3 and comprising:

a. one of said brackets having an outwardly directed prong;

b. the other bracket having a receptacle for receiving said prong; and, c. said locking means comprising a combination lock for releasably securing together said prong in said receptacle.

* * * * *